United States Patent [19]

Moji

[11] 4,064,020

[45] Dec. 20, 1977

[54] PREPARING AN ENVIRONMENTALLY STABLE STAINLESS SURFACE FOR BONDING

[75] Inventor: Yukimori Moji, Seattle, Wash.

[73] Assignee: The Boeing Company, Seattle, Wash.

[21] Appl. No.: 643,281

[22] Filed: Dec. 22, 1975

[51] Int. Cl.[2] ..... C25D 11/34; C25D 11/38

[52] U.S. Cl. ..... 204/38 E; 204/56 R

[58] Field of Search ..... 204/56 R, 38 E, 129.75, 204/129.9; 428/469, 416; 156/150, 151; 427/410

[56] References Cited

U.S. PATENT DOCUMENTS

| | | | |
|---|---|---|---|
| 2,375,210 | 5/1945 | Batcheller | 204/56 R |
| 3,804,730 | 4/1974 | Evans et al. | 204/56 R |

*Primary Examiner*—R. L. Andrews

*Attorney, Agent, or Firm*—Morris A. Case

[57] ABSTRACT

A method of preparing a stainless steel surface for bonding by anodically treating the steel in an electrolytic bath, at a temperature of 60° F to 180° F, of an aqueous solution of sulfuric acid or an aqueous solution of sulfuric and chromic acids with an impressed voltage during anodizing of a range to remain within the passive region of the stainless steel.

17 Claims, 2 Drawing Figures

PREPARING AN ENVIRONMENTALLY STABLE STAINLESS SURFACE FOR BONDING

BACKGROUND OF THE INVENTION

There has been an explosive increase in the availability and use of organic adhesives, sealants and coatings. Adhesion is a basic requirement common to the application of these materials whether their function is structural, protective or decorative. Reliable adhesion depends upon cleaning and preparation of the adhering surface. The purpose of surface preparation is to remove weak surface layers of soils and corrosion products, usually oxides, and to generate a cohesively strong and wetable surface layer that has a high affinity for adhesives, coatings and sealants. The other important requisites for the surface treatment is that the newly generated surface layer must be environmentally stable under the combined influence of stress, elevated temperature and moisture. Dorsey U.S. Pat. No. 3,616,310 teaches surfaces preparation of aluminum for bonding using an aqueous bath of 7 to 12 percent sulfuric acid and 0.25 to 0.80 percent chromic acid with the aluminum anodized at 10 to 30 amps per square foot at a temperature of about 68° F to 86° F. It is known to prepare an environmentally stable aluminum surface for bonding by anodizing in an aqueous sulfuric chromic acid bath at 130° F to 160° F and 1 to 2.5 volts, for from 2.5 to 20 minutes. Batcheller U.S. Pat. No. 2,409,097 shows the use of an aqueous acid bath of 15 to 55 weight percent sulfuric acid and 2 to 20 weight percent chromic acid to electro-chemically polish stainless steel alloys using the steel as an anode with a bath temperature of above 160° F and a current flow of 1½ to about 15 amperes per square inch of anode. It is also known to prepare stainless steel for bonding by anodic etching in an aqueous sulfuric acid bath at 6 volts for 90 seconds in a 75° F bath. There are other known processes for preparing a stainless steel surface for bonding and generally all of these processes produce a bonding surface with satisfactory initial mechanical strengths, but the difficulty has been to produce an environmentally stable bond. It was discovered an environmentally stable stainless steel surface for bonding is obtained by anodizing stainless steel with a current flow of from 0.3 to 6 amperes per square foot in an aqueous sulfuric acid or an aqueous sulfuric chromic acid bath.

SUMMARY OF THE INVENTION

A stainless steel to be bonded is connected to an anode of a pair of electrodes, a potential imparted between the electrodes and the part immersed in an electrolyte. The electrolyte is an aqueous solution of sulfuric acid, preferably having a concentration of about 400 to 600 grams per liter (g/l) or an aqueous solution of sulfuric and chromic acid preferably having a concentration of about 300 to 400 g/l of sulfuric acid and 30 to 40 g/l of chromic acid. The bath containing the electrolyte is maintained at a temperature of about 60° F to 180° F and the impressed potential across the electrodes of a range to maintain the anodizing within the passive region of the stainless steel for a period ranging up to about 30 minutes.

It is an object of this invention to provide a method of preparing a stainless steel surface to be used for bonding to impart environmental stability to the bonded surface.

DETAILED DESCRIPTION

The interface between the surface of a material to be bonded and the material used as an adhesive to effect the bond is usually the weak link in preparing bonded articles. Even if a good bond is obtained so that failures, if any, are cohesive and not adhesive, it may still be the adhesive bond that is critical if the interfacial bond deteriorates due to operating conditions such as stress, moisture and/or heat. It was desirable to compare a stainless steel surface prepared for bonding to impart environmental stability to the bond by the use of this invention with known methods of preparing stainless steels for bonding. Test specimens were prepared and tested by wedge testing and by lap shear testing.

The primary bond performance criteria in the wedge tests was fracture propagation and fracture mode, i.e. cohesive or interfacial (adhesive) failure when wedge specimens were exposed to a hot, humid environment. Bonded test specimens were prepared using five state-of-the-art stainless steel surface preparation methods as well as surface preparation by the methods of this invention. The wedge test specimens were identically prepared other than the method of preparing the surface for bonding. The specimens used two identically processed panels 0.125 inch thick. The panels preferably use a primer and an adhesive. The primer may be any suitable primer such as a corrosion inhibiting epoxy primer designated as BR127, manufactured and sold by American Cyanamide Corporation, which was used to prepare these specimens. This primer is a 250° F cure epoxy resin suitable as a corrosion inhibiting primer for bare metal surfaces. Any of the known adhesives may be used that are compatible with the primer, but for these tests, a modified epoxy resin designated as AF126 having a 250° F cure and manufactured by Minnesota Mining and Manufacturing Corporation was used. The assemblies were cured in an autoclave at 250° F under 50 psi pressure for 90 minutes. The specimens were prepared for the wedge test by opening an end of the strips and forcing a 0.125 inch thick wedge between the adherends, taking care that the wedge maintained a sustained stress on the crack tip. The specimens were exposed for 24 hours at 140° F100% relative humidity, and the crack growth measured at the end of 1, 4 and 24 hours. At the termination of these tests, each specimen was torn apart and the failure modes were examined with particular attention directed to the area along which failure had occurred to determine if failure was adhesive or cohesive.

Figure 1:
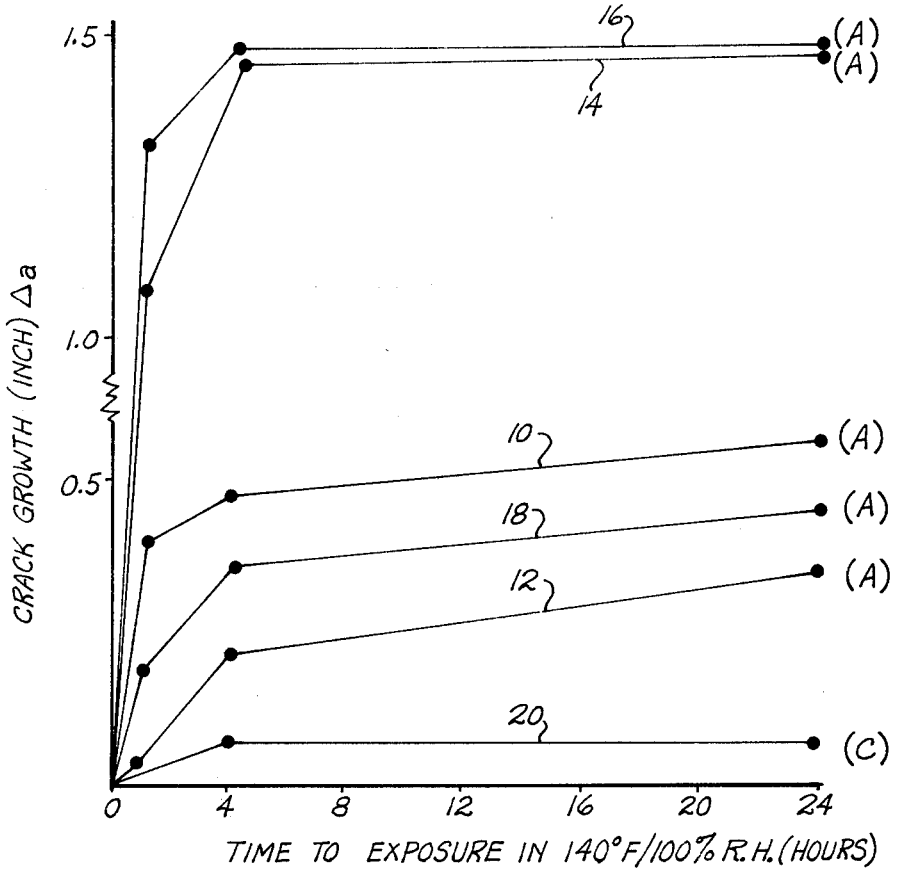
FIG. 1 is a graph depicting crack growth in adhesive bonds on varying methods of preparing the surface before bonding.

The results of the wedge testing are shown graphically in FIG. 1. The lines represent the crack growth results of various methods of preparing stainless steel for bonding. The letter in parenthesis at the right side of the end of each line represents the mode of failure, with the letter (A) representing an adhesive failure and the letter (C) representing cohesive failure. The surface preparation for each of the lines are as follows:

Preparation A as shown by line 10 was anodically etched in 500 g/l of $H_2SO_4$ for 90 seconds at 6 volts and 75° F with a latter immersion in 5% $CrO_3$ at 100° F for 20 minutes.

Preparation B as shown by line 12 was etched in 50gm KBr per liter of 1:9:10 ($H_2SO_4$:$H_3PO_4$:$H_2O$) at 205° F for 10 minutes.

Preparation C as shown by line 14 was etched in $H_2SO_4$—Formalin—$H_2O_2$ at 150° F for 10 minutes with a later immersion in $H_2SO_4$-$Na_2Cr_2O_7$-$2H_2O$ at 150° F for 10 minutes.

Preparation D as shown by line 16 was etched in 30% $H_2SO_4$ at 140° F for 5 minutes with a latter immersion in $H_2SO_4$-$Na_2Cr_2O_7.2H_2O$ at 150° F for 3 minutes.

Preparation E as shown by line 18 was etched in HCl-$CuSO_4$ at room temperature for 6 minutes.

Preparation F, the process of this invention, as shown by line 20 was anodically etched in 500 g/l $H_2SO_4$ at 75° F for 20 minutes at 1.5 volts with a later immersion in 5% $CrO_3$ at 100° F for 20 minutes.

It is readily apparent that preparation F compares favorably with the state-of-the-art surface preparations as the crack growth after 24 hours was about 0.1 inches, whereas the crack growth of the others ranged from about 0.4 inches to 1.5 inches and the method of failure showed cohesive failure whereas all of the others showed adhesive failure.

Sustained stress lap shear test specimens with surface preparation as shown above for the wedge test specimens were prepared and bonded as set out above. These specimens were 1 inch wide and had a ½ inch wide overlap in the bonded area and were subjected to a dead load of 1000 pounds (2000 psi). Several test specimens with each surface preparation were tested for time to failure under the 1000 pound load in an atmosphere at 140° F/100% relative humidity, and later examined to determine the mode of failure. Preparation F, which is the process of this invention, again compared favorably as is evident from Table 1 below, which shows longer time to failure and essentially cohesive failure as compared to essentially adhesive failure for the other surface preparations.

TABLE I

| Surface Preparation | Conditions: 2000 psi at 140° F/100% Humidity | | | | | |
|---|---|---|---|---|---|---|
| | Time to Failure Hours | | | Failure Mode % Adhesive | | |
| | Low | High | Ave | Low | High | Ave |
| Preparation A | 33 | 65 | 48 | 50 | 80 | 66 |
| Preparation B | 15 | 40 | 28 | 40 | 80 | 68 |
| Preparation C | 13 | 23 | 20 | 70 | 85 | 78 |
| Preparation D | 22 | 55 | 42 | 70 | 80 | 76 |
| Preparation E | 36 | 68 | 59 | 40 | 60 | 54 |
| Preparation F | 69 | 84 | 76 | 10 | 20 | 17 |

Preparation F surface treatment was also compared with several other preparation methods, bonded test specimens prepared and wedge tested to determine crack growth at 140° F/100% relative humidity, and to determine the mode of failure. Those methods include:

Preparation F-1, an anodic etch in 500 g/l $H_2SO_4$ at 75° F for 20 minutes at 1.5 volts, but did not require later passivation in 5% $CrO_3$.

Preparation G, an anodic etch in 500 g/l $H_2SO_4$ and 100 g/l $H_3PO_4$ at 75° F for 20 minutes at 1.5 volts with later passivation in 5% $CrO_3$.

Preparation H, an anodic etch in 500 g/l $H_3PO_4$ at 75° F for 20 minutes at 1.5 volts, and a later passivation in 5% $CrO_3$.

Preparation J, an anodic etch in 300 g/l $H_2SO_4$ and 30 g/l $Na_2Cr_2O_7.2H_2O$ at 75° F for 20 minutes at 1.5 volts, and later passivation in 5% $CrO_3$. Wedge test specimens prepared with preparations F, F-1, and J had crack growth of about 0.1 inch in 30 days and showed cohesive failure, while specimens prepared with preparations G and H each had about 1.1 inches of crack growth and both showed an adhesive failure mode.

Numerous specimens were prepared and tested to determine method parameters. It was found the concentration of the sulfuric acid bath could vary from about 200 to 600 g/l with a concentration range of 400 to 600 g/l or of about 500 gl preferred. The concentration for the sulfuric acid sodium dichromate bath varied from 300 to 400 g/l of sulfuric acid and 30 to 40 g/l of sodium dichromate. Anodizing time varied from 5 to 30 minutes with about 10 to 20 minutes preferred. Best results were obtained by affixing the anode to the stainless steel part before immersing in the bath, and having an impressed voltage on the part at all times while in the electrolytic bath.

Figure 2:
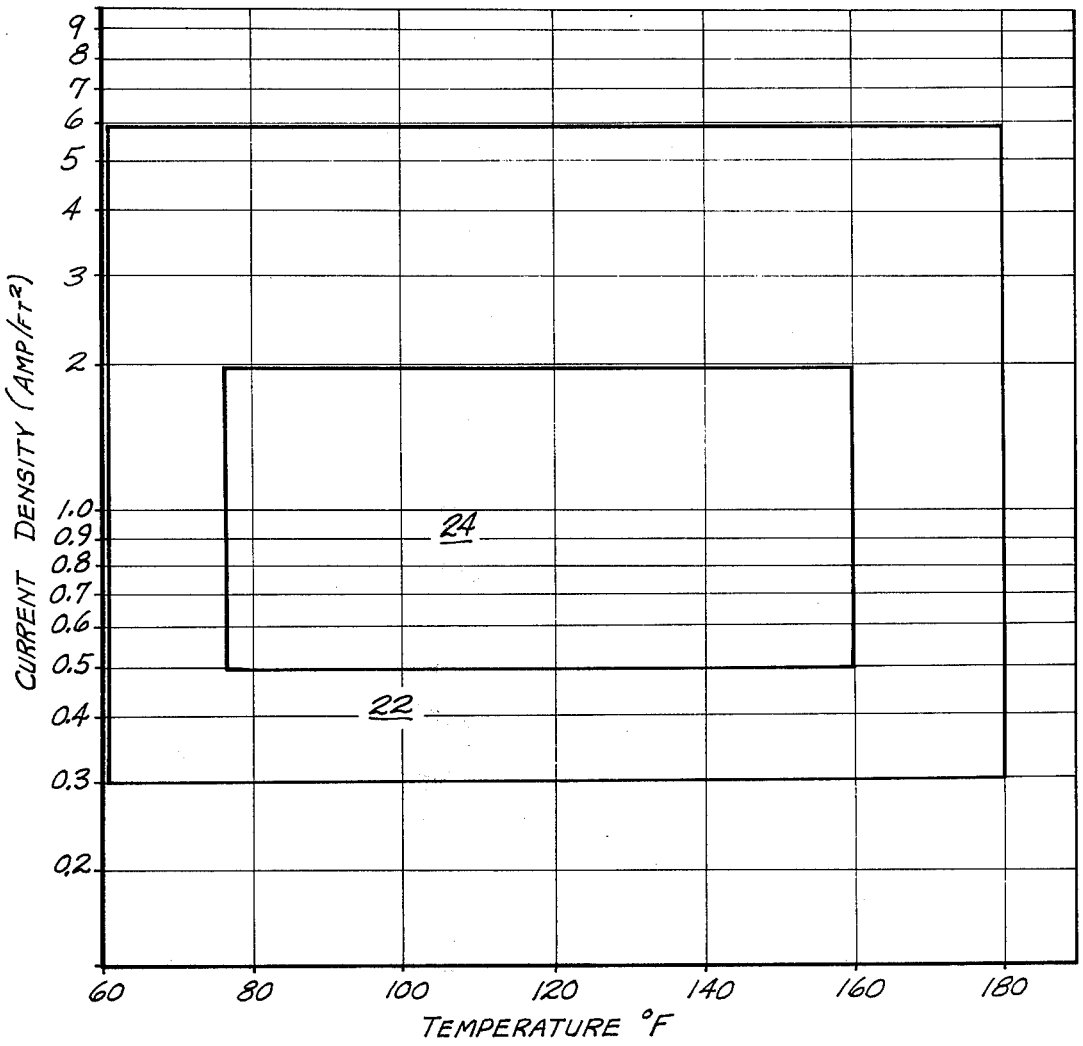
FIG. 2 is a graph showing invention parameters of current density vs. temperature.

FIG. 2 graphically shows the parameters for temperature and for current density as bounded by line 22. Thus, it shows a temperature range of from 60° F to 180° F and a current density of 0.3 to 6 amperes per square foot. These current densities are obtained by an impressed voltage across the electrodes, and to obtain the desired current flow, the voltage normally was varied between 1 and 2.5 volts. In a large capacity tank, the potential may require increasing to a slightly higher voltage to maintain the proper current flow.

When the applied voltage is decreased below 1 volt, the results of wedge tests indicate considerably more crack extension and more tendency to adhesive failure. When the voltage is increased to 3 volts, the current density increases markedly to 30 amperes per square foot, the coating appears to dissolve, and failure is 100% adhesive.

The electro-chemical behavior of the stainless steel appears to be similar to that of other passivating type metals such as titanium. The polarization curves of typical active-passive metals can be conveniently divided into three regions—active, passive and transpassive. In the active region, slight increases in the oxidizing power of the solution (increasing noble potential) cause a corresponding increase in the corrosion rate (current density). If oxidizing power is increased, the corrosion rate or current density shows a sudden decrease. This corresponds to the beginning of the passive region. Further increase in oxidizing power produces little change in the current density until the end of the passivating region is reached, at which point, with an increase in the oxidizing power (voltage), the current density increases very rapidly. This region is termed the transpassive region. The impressed voltage to obtain the 0.3 to 6 amperesft$^2$ corresponds to the passive range of stainless steel. The cause of this passivation of stainless is not completely understood. It is a special case of activation polarization due to formation of surface film or protective barrier which is stable over a range of applied potential voltage, and eventually the polarization is destroyed as voltage is increased and the current density rapidly increasing in the transpassive region.

I claim:

1. A method of preparing a stainless steel surface to provide an environmentally stable interfacial bond with an adhesive, the steps of preparing the stainless steel surface comprising: subjecting the steel to electrolytic action as an anode in an electrolyte consisting of an aqueous sulfuric acid bath containing about 400 to 600 grams per liter of sulfuric acid at about 80° F to 160° F, introducing a voltage for imparting about 0.3 to 6 amperes/foot$^2$ on the anode, and maintaining current flow for about 5 to 25 minutes.

2. A method as in claim 1 with the sulfuric acid concentration at about 500 grams per liter, maintaining the temperature at about 120° F to 130° F, and utilizing electric current flow for about 20 minutes.

3. A stainless steel article having a surface prepared by the method of claim 2.

4. A stainless steel article having a surface prepared by the method of claim 1.

5. A method of preparing stainless steel to provide an environmentally stable interfacial bond with an adhesive, the steps of preparing the stainless steel surface comprising: connecting a stainless steel article to the anode of a pair of electrodes, imparting a voltage across the electrodes and introducing an electric current of about 0.3 to 6 amperes/foot$^2$ on the article, and immersing the steel with anodic electrode into an electrolyte for 5 to 30 minutes, said electrolyte maintaining a temperature of about 75° F to 160° F and consisting essentially of an aqueous solution of sulfuric acid or of sulfuric acid and hexavalent chromium ion with the chromium ion concentration ratio about 1/7 to 1/13 of the concentration of the sulfuric acid.

6. A method as in claim 5 wherein the stainless steel is anodized in 200 to 400 grams per liter of sulfuric acid at a temperature of 120° F to 130° F for about 20 minutes.

7. A stainless steel article having a surface prepared by the method of claim 6.

8. A method as in claim 5 wherein the stainless steel is anodized in 300 to 400 grams per liter of sulfuric acid and 30 to 40 grams per liter of sodium dichromate at 75° F to 160° F for about 20 minutes.

9. A stainless steel article having a surface prepared for bonding by the method of claim 8.

10. A stainless steel article having a surface prepared by the method of claim 5.

11. A stainless steel article having an adhesive coated surface, said surface prepared for the adhesive by anodizing in an electrolytic aqueous bath from 75° F to 160° F for 5 to 30 minutes at a voltage potential for imparting about 0.3 to 6 amperesfoot$^2$, said bath consisting of 400–600 grams per liter of sulfuric acid or 300–400 grams per liter of sulfuric acid and 30–40 grams per liter of $CrO_3$.

12. A stainless steel article as in claim 11 wherein the electrolyte is sulfuric acid.

13. A stainless steel article as in claim 11 wherein the electrolyte is sulfuric acid and $CrO_3$.

14. A method of preparing a stainless steel surface to provide an environmentally stable interfacial bond with an adhesive, the steps of preparing the stainless steel surface surface comprising: utilizing stainless as an anode in an aqueous bath consisting essentially of sulfuric acid or of sulfuric acid and a hexavalent chromium ion with the hexavalent chromium ion concentration about 1/7.5 to 1/13 the concentration of the sulfuric acid and impressing a voltage potential across the electrodes in the bath to impart an electric current of about 0.3 to 6 amperes per square foot to the anode for about 5 to 30 minutes.

15. A method of preparing a stainless steel surface as in claim 14 further comprising: maintaining the aqueous bath at a temperature of about 60° F to 140° F.

16. A method of preparing a stainless steel surface as in claim 15 wherein the aqueous bath contains sulfuric acid.

17. A method of preparing a stainless steel surface as in claim 15 wherein the aqueous bath contains sulfuric acid and hexavalent chromium ions.

* * * * *